United States Patent [19]

Klusmier

[11] 4,174,662

[45] Nov. 20, 1979

[54] HEXAGONAL BUNDLE FORMING APPARATUS

[75] Inventor: Kenneth L. Klusmier, Worcester, Mass.

[73] Assignee: Morgan Construction Company, Worcester, Mass.

[21] Appl. No.: 907,482

[22] Filed: May 22, 1978

[51] Int. Cl.[2] ..... B65B 13/00

[52] U.S. Cl. ..... 100/7; 414/748

[58] Field of Search ..... 100/2, 7, 8; 53/198 R; 214/6 DR, 1 P, 1 PB, 1 R, 6 S

[56] References Cited

U.S. PATENT DOCUMENTS 3,299,609 1/1967 Hill ..... 100/7 X 3,956,982 5/1976 Hill ..... 100/7 X

FOREIGN PATENT DOCUMENTS 969007 4/1958 Fed. Rep. of Germany ..... 214/1 PB 1420465 11/1965 France ..... 214/1 P

*Primary Examiner*—Billy J. Wilhite

*Attorney, Agent, or Firm*—Thompson, Birch, Gauthier & Samuels

[57] ABSTRACT

An apparatus for forming elongated elements such as round bars, pipes and the like into a hexagonal bundle. Tiers containing appropriate numbers of elongated elements are deposited one upon the other in an assembly zone. The assembly zone is defined by a plurality of support surfaces, one of which is stationary, and the remainder of which are adjustable in relation to the stationary support surface in order to gradually impart a hexagonal cross section to the elements accumulating in the assembly zone. The completed assemblage of elements is then externally tied into a bundle in order to substantially retain the aforesaid hexagonal cross section after the bundle is removed from the assembly zone.

10 Claims, 21 Drawing Figures

HEXAGONAL BUNDLE FORMING APPARATUS

TECHNICAL FIELD

This invention relates generally to the art of material handling and is concerned in particular with an apparatus for forming elongated elements such as round bars, pipes and the like into hexagonal bundles.

BACKGROUND OF THE PRIOR ART

In the past, hexagonal bundles have been made from elongated elements such as round bars, pipes and the like by haphazardly rolling the elements off of collecting skids into hexagon-shaped cradles. This produces a non-uniform distribution of elements requiring the continuous attention of operating personnel, who must manually rearrange the elements in order to properly fill the cradles. This method is extremely noisy and dangerous. Moreover, the elements are often scratched or marked as they are dropped into the cradles.

BRIEF SUMMARY OF THE INVENTION

The present invention avoids the above-mentioned problems by preliminarily arranging the elongated elements in ordered tiers which are then gently deposited in a controlled manner, one upon the other, in an assembly zone. The assembly zone is defined by a plurality of support surfaces, one of which is stationary, and the remainder of which are movably adjustable in relation to the stationary support surface in order to gradually impart a hexagonal cross section to the elongated elements accumulating in the assembly zone. Adjustment of the movable support surfaces is coordinated with the deposit of successive element tiers in the assembly zone, with the result that the individual elements undergo minimum shifting and relative movement. This minimizes noise, eliminates or at least substantially minimizes scratching and marking of the elements, and eliminates the need for constant manual rearrangement of elements by operating personnel.

DETAILED DESCRIPTION OF INVENTION

Figure 1:
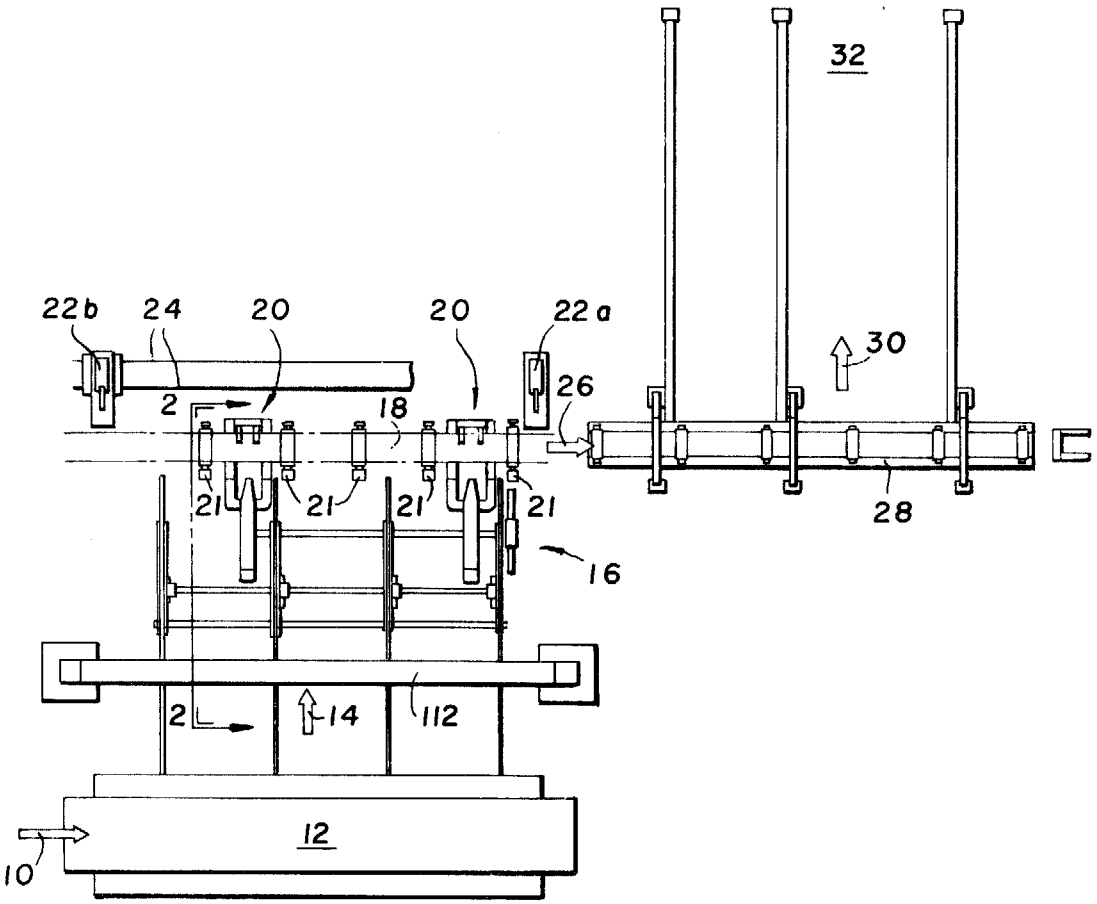
FIG. 1 is a general plan view of a typical product handling area employing a hexagonal bundle forming apparatus in accordance with the present invention.

Referring initially to FIG. 1, a typical layout including apparatus in accordance with the present invention is shown wherein elongated elements such as round bars or tube products are directed longitidunally in the direction of arrow 10 to an inspection station 12. From station 12, the elements move laterally in a single layer in the direction of arrow 14 to a delivery means generally indicated at 16. The delivery means 16 in turn operates to deposit successive tiers of elements, one upon the other, in an assembly zone depicted by dot-dash lines at 18. The assembly zone is formed by a plurality of aligned units 20. The units 20 accumulate the element tiers in a hexagonal assemblage which is then tied by one or more strapping devices, one strapping device **22*a* being stationary and the other strapping device 22*b* being movable along rails 24. Pivotal roller table assemblies 21 are then employed to longitudinally eject completed bundles from the assembly zone 18 in the direction of arrow 26 to a lateral discharge apparatus 28 which then shifts the bundles in the direction of arrow 30 to a storage area 32**.

Referring now to FIGS. 2-5, it will be seen that the units 20 each comprise a sloping stationary "first" support surface $s_1$ defining one side of the assembly zone 18. Surface $s_1$ may conveniently be formed by laterally spaced members 34 (see FIG. 4) secured to an upstanding housing 36. An outer carriage 38 has wheels 40 arranged to run along the members 34. The outer carriage 38 is adjustable in a direction parallel to the first support surface $s_1$ by a first operating means 42 which typically may consist of a screw jack or other equivalent device. The outer carriage 38 has a horizontal "second" support surface $s_2$ having one end located directly adjacent to the first support surface $s_1$.

Figure 6A:
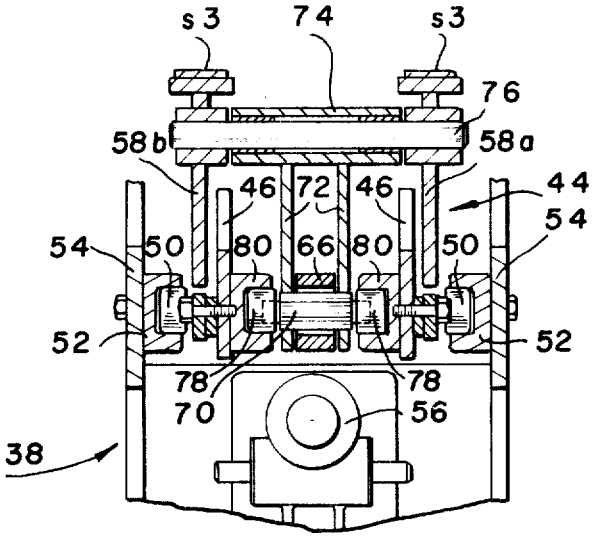
FIGS. 6A, 6B, 7, 8 and 9 are sectional views taken respectively along lines 6A—6A, 6B—6B, 7—7, 8—8 and 9—9 of FIG. 5.
Figure 6B:
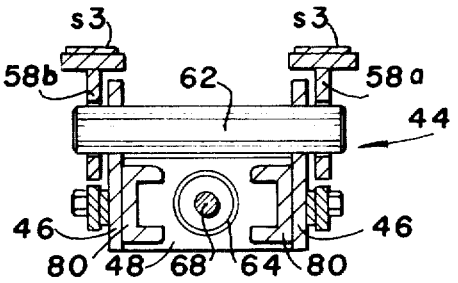

An inner carriage generally depicted at 44 is mounted on the outer carriage 38 for movement in relation thereto in a direction perpendicular to the first support surface $s_1$. As can best be seen by further reference to FIGS. 6A and 6B, the inner carriage has side panels 46 suitably interconnected by transverse braces 48. The side panels 46 carry wheels 50 which run along U-shaped tracks 52 fixed to the interior surfaces of side panels 54 on the outer carriage 38. The tracks 52 guide the inner carriage 44 for reciprocal movement relative to the outer carriage 38 in a direction perpendicular to the first support surface $s_1$. The inner carriage 44 is moved relative to the outer carriage 38 by means of another screw jack or equivalent device 56.

An outer arm generally depicted at 58 includes parallel arm panels **58*a*, 58*b* interconnected by a transverse tubular brace 60. The arm panels 58*a*, 58*b* are pivotally connected to the inner carriage 44 by means of a pin 62 extending transversally between the inner carriage side panels 46. The outer arm has "third" and "fourth" support surfaces $s_3$ and $s_4$ arranged to define two additional sides of the assembly zone 18. When the outer arm 58 is in the closed position shown by the solid lines in FIG. 5**, the third support surface $s_3$ is sloped oppositely to the first support surface $s_1$ and is adjacent to the horizontal second support surface $s_2$, whereas the fourth support surface $s_4$ is parallel to the first support surface $s_1$ and adjacent to the third support surface $s_3$.

Adjustment of the inner carriage 44 relative to the outer carriage 38 along the tracks 52 thus results in a shifting of outer arm 58 and its support surfaces $s_3$, $s_4$ relative to the support surfaces $s_1$ and $s_2$. This adjustment allows the apparatus to produce different sizes of hexagonal cross sections, the maximum and minimum of which are depicted by dot-dash lines in FIG. 3.

For reasons which will hereinafter become apparent, the outer arm 58 is pivotally adjustable between the closed position referred to above and an open position 58' indicated by the dot-dash lines in FIG. 5. This pivotal adjustment is accomplished by means of a linear actuator 64 having the head 66 of its piston rod 68 pivotally connected to an axle 70 extending transversely between bracket members 72 depending from a cylindrical collar 74. The collar 74 extends between the outer arm panels 58*a*, 58*b* and is pivotally connected thereto by means of a pin 76. Axle 70 carries wheels 78 arranged to run along a second set of U-shaped tracks 80 mounted on the interior surfaces of the inner carriage sides 46. The tracks 80 on the inner carriage are parallel to the tracks 52 on the outer carriage. It will thus be seen that extension and retraction of piston rod 68 will produce pivotal movement of outer arm 58 between the aforesaid closed and open positions.

Figure 5:
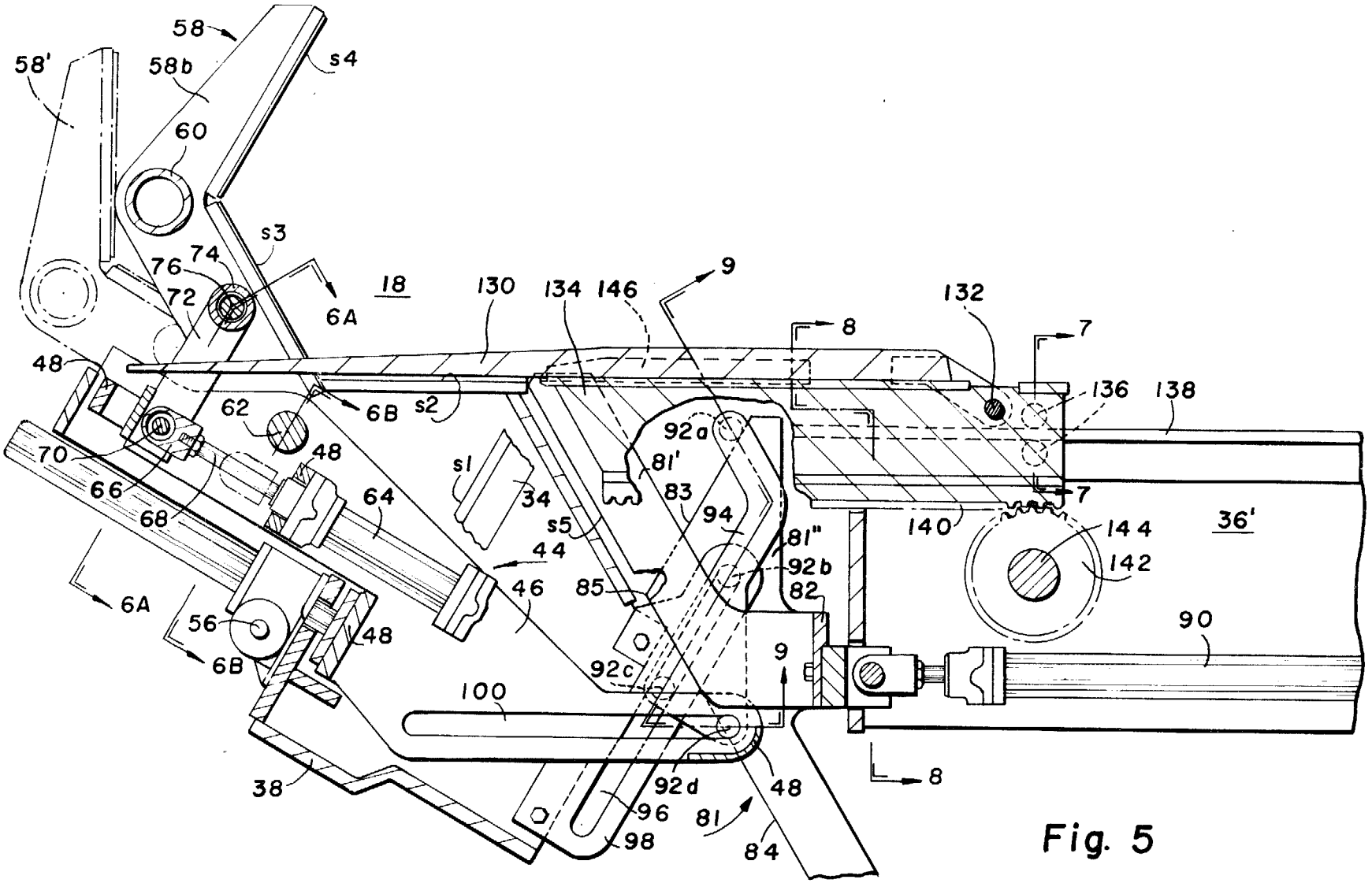
FIGS. 5 and 5A are sectional views on an enlarged scale taken along lines 5—5 of FIG. 4.
Figure 8:
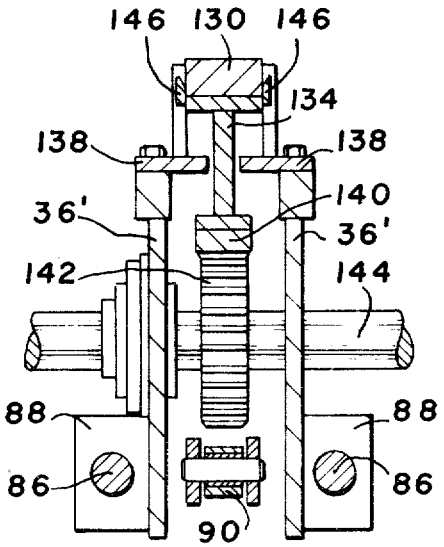
Figure 10:
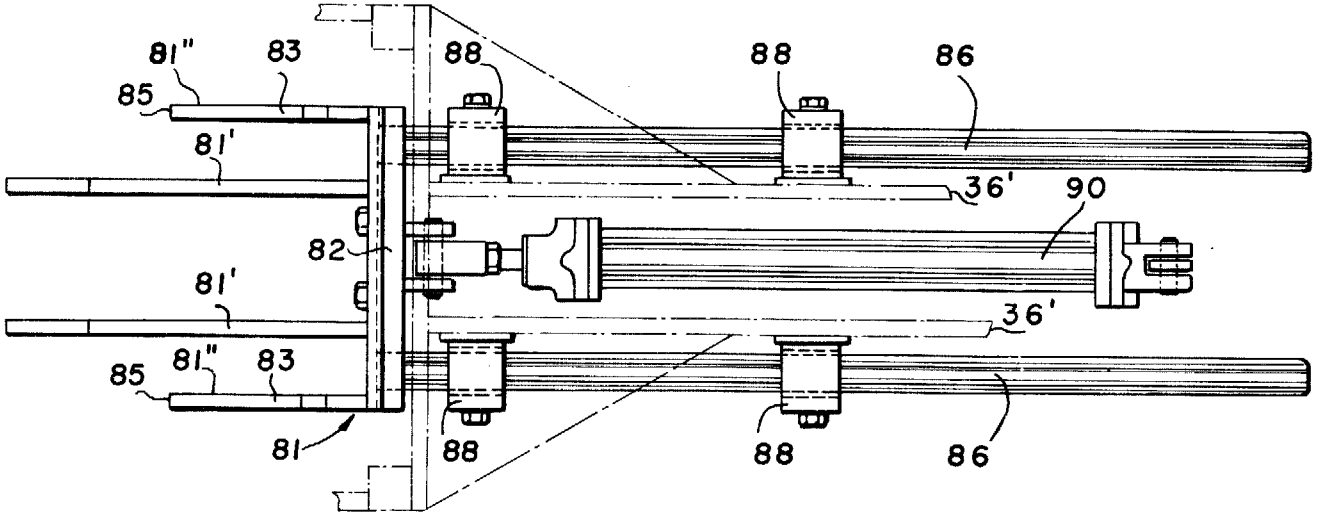
FIG. 10 is a horizontal view showing the second operating means for movably adjusting the inner arm.

As can best be seen by reference to FIGS. 5, 8 and 10, an inner arm generally depicted at 81, includes a pair of parallel inclined arm members 81' and a pair of parallel cam members 81" all interconnected by a cross brace 82. The inner edges of the arm members 81" cooperate in providing a "fifth" support surface $s_5$ arranged to define a fifth side of the assembly zone 38. The inner edges of the cam members 81" define cam segments 83, 84 converging at shoulders 85. Cam segments 84 are aligned laterally with the fifth support surface $s_5$, whereas cam segments 83 extend rearwardly from shoulders 85 and are parallel to the first support surface $s_1$.

Tubular guides 86 extend rearwardly from the cross brace 82 and are slidably received in bearings 88 fixed to a rearward extension 36' of the housing 36. A "second" operating means in the form of a linear actuator 90 is employed to movably adjust the inner arm 81 in a direction transverse to the direction of movement of the outer carriage 38.

Figure 9:
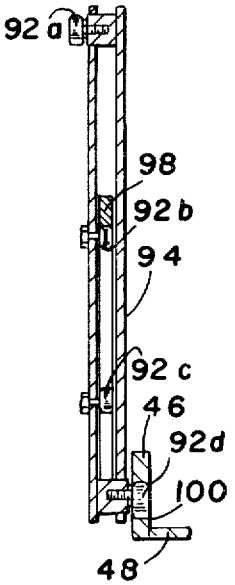

The cam segments 83, 84 are aligned for contact with cam rollers 92*a* carried on control links 94, only one of which is shown in the drawings in FIGS. 5 and 9. In addition to the cam rollers 92*a*, the control links also have guide rollers 92*b*, 92*c* and 92*d*. Guide rollers 92*b*, 92*c* are arranged to run along slots 96 in brackets 98 attached to the outer carriage 38. The slots 96 extend longitudinally in a direction parallel to the first support surface $s_1$. The fourth guide rollers 92*d* of the control links run along a second set of slots 100 in the lowermost regions of the side plates 46 on the inner carriage 44. The slots 100 are horizontal and parallel to the direction of movement of the inner arm 81. The function of the cam segments 83, 84 control links 94 and cam rollers 92*a* will be described presently.

Figure 2:
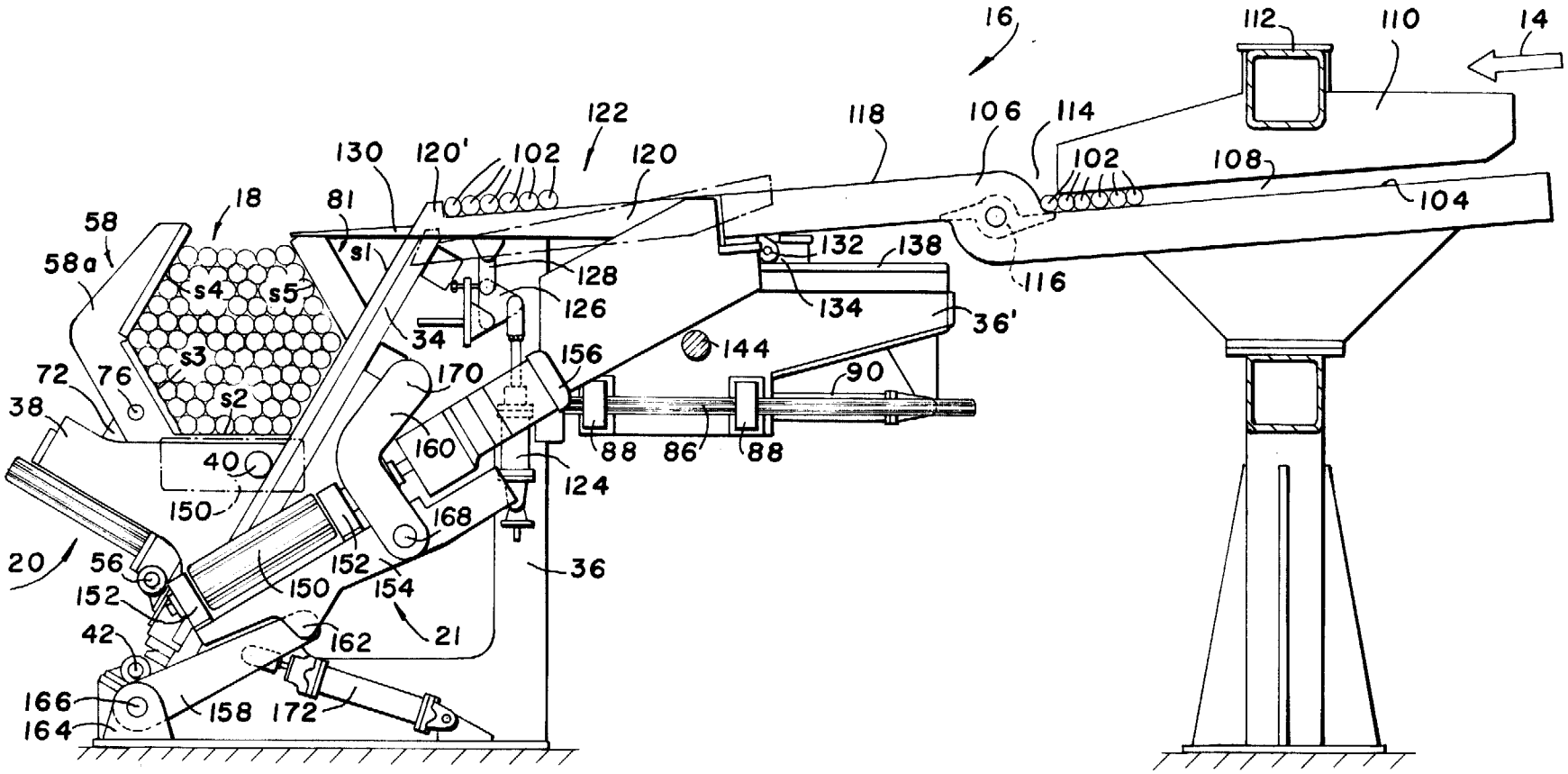
FIG. 2 is a vertical sectional view on a greatly enlarged scale taken along lines 2—2 of FIG. 1, showing a completed assemblage of elongated elements in the assembly zone prior to the application thereto of external ties.
Figure 3:
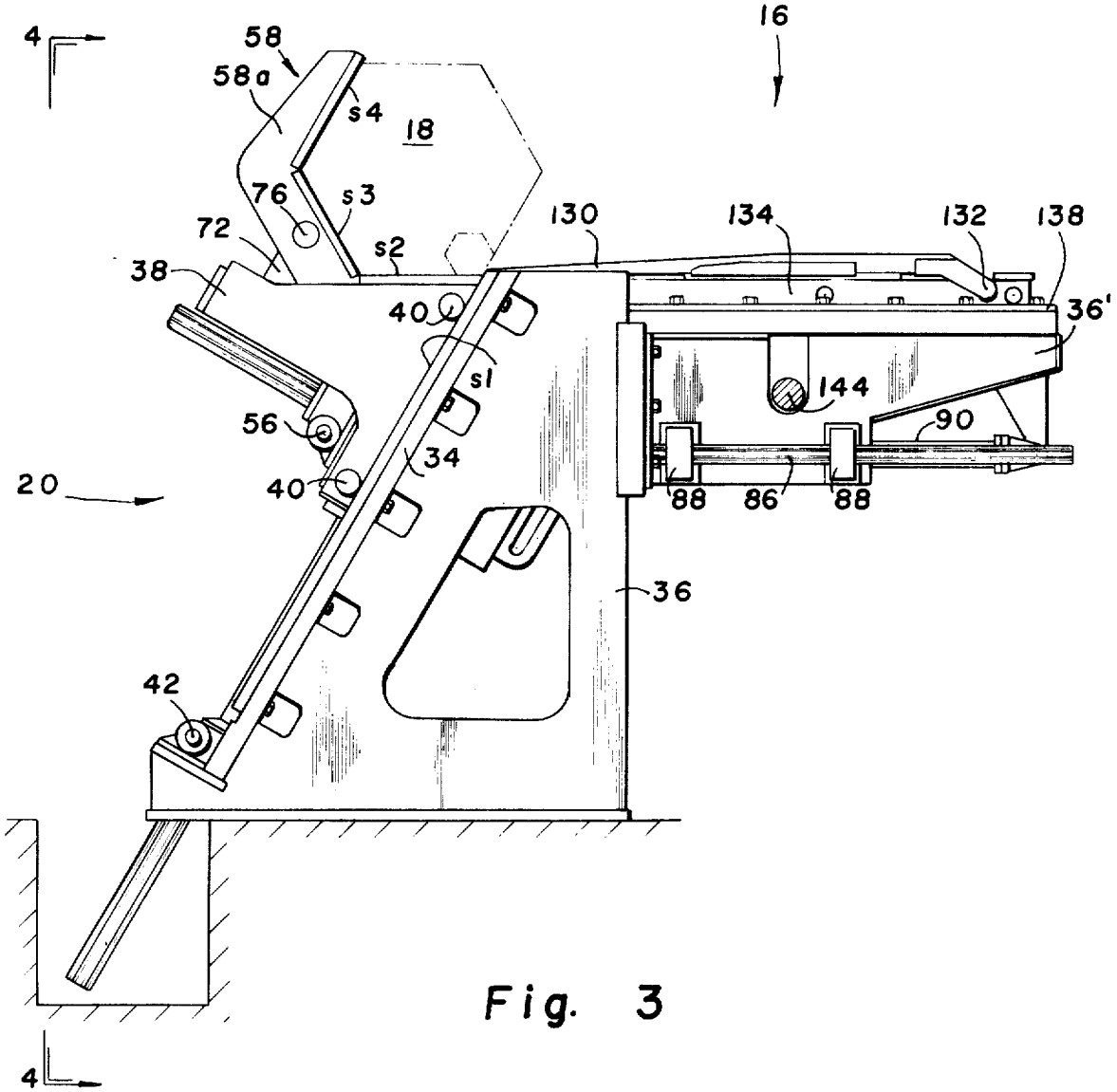
FIG. 3 is a view similar to FIG. 1 with the pivotal roller table assembly and portions of the delivery means removed.
Figure 4:
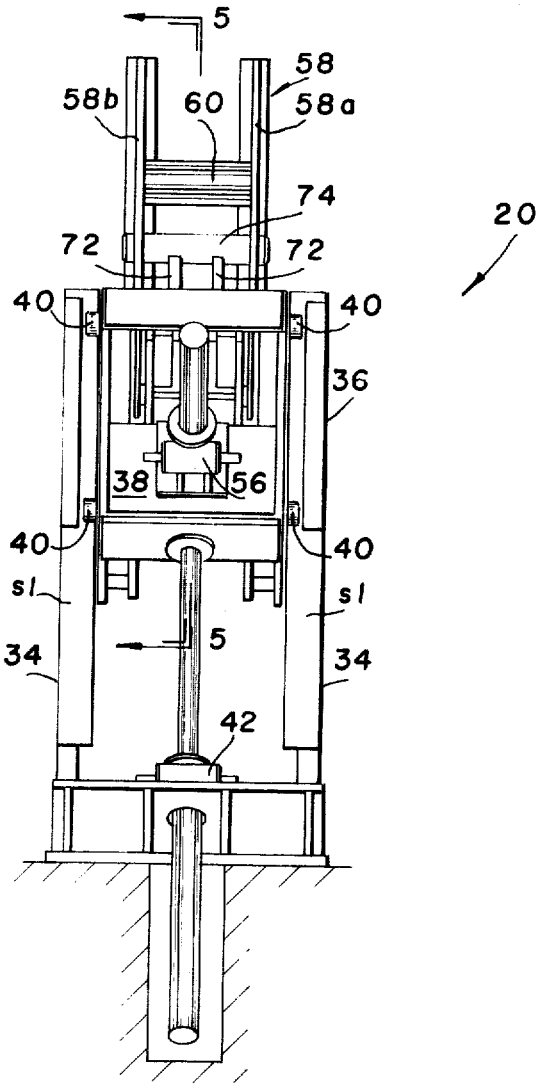
FIG. 4 is a side view taken along lines 4—4 of FIG. 3.

The delivery means generally depicted at 16 will now be described in greater detail with reference to FIG. 2. Elongated elements 102, herein depicted for illustrative purposes as round bars, are received in the direction of arrow 14 from the inspection station 12. The elements roll down an inclined surface 104 to a curved shoulder 106 against which they accumulate in a single layer in a zone 108. An upper guide 110 carried on a cross beam 112 extends over the surface 104. The upper guide 110 cooperates with the shoulder 106 to define a space 114 through which individual elements may be lifted by a rotatable picker 116. Although not shown, it is to be understood that the upper guide 110 is adjustable to vary the width of the space 114 as well as the vertical spacing of the upper guide relative to the underlying surface 104 so as to accommodate a range of element diameters.

The picker 116 lifts individual elements over the shoulder 106 onto a ramp 118 which slopes downwardly toward the assembly zone 18. The elements roll laterally down the ramp onto pivotal stop members 120 having upstanding stops 120'. The elements accumulate against the stops 120' at a tier forming zone indicated generally at 122. The stop members 120 are pivotally movable between raised positions shown by solid lines in FIG. 2 and lowered positions shown by dot-dash lines in the same illustration. This pivotal adjustment is accomplished by a vertical linear actuator 124 operating through a bell crank 126 and an intermediate link 128.

Figure 7:
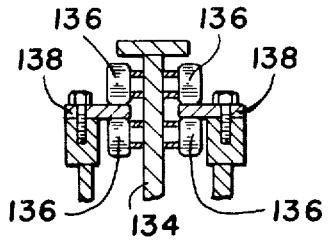

A plurality of skids 130 operate in conjunction with the pivotal stop members 120 to deliver element tiers to the assembly zone 18. As is best shown in FIGS. 5, 7 and 8, the skids 120 are pivotally mounted at their rearward ends by cross pins 132 on carriers 134 having guide wheels 136 arranged to run along the upper and lower surfaces of guide tracks 138. The tracks 138 are secured to the upper surfaces of the rearward housing extension 36'. The carriers have gear racks 140 on their undersides. The gear racks are arranged to mesh with pinions 142 carried on a cross shaft 144. Rotation of the cross shaft in a counterclockwise direction as viewed in FIG. 5 will advance the carriers 134 and their respective skids 130 towards the assembly zone 18, whereas rotation of the cross shaft in a clockwise direction will retract the carriers and their respective skids away from the assembly zone. The skids 130 rest on the tops of the carriers between bevelled side guides 146. A carrier 134 and its respective skid 130 is shown in an advanced position protruding into the assembly zone 18 in FIG. 5, and in a retracted position behind the first support surface $s_1$ and out of the assembly zone 18 in FIG. 3.

Completed bundles are removed from the assembly zone by means of the pivotal roller table assemblies 21. As shown in FIG. 2, each assembly 21 includes a table roller 150 journalled between bearings 152 arranged on an adjustable base 154. The roller is driven by a motor 156. Base 154 is movably mounted by means of two pivotal links 158, 160. Link 158 is pivotably connected at opposite ends to the base at 162 and to a bottom stationary bracket 164 at 166. Link 160 is likewise connected at opposite ends to the adjustable base 154 at 168 and to the housing 36 at 170. A linear actuator 172 operates on link 158 to pivot the table roller 150 from a lowered inoperative position shown by the solid lines in FIG. 2 to a raised operative position indicated at 150' by the dot-dash lines in the same illustration.

Referring now to the FIGS. 11A–11I, the operation of the apparatus will now be described, it being understood that all units 20 are adjusted identically and operated simultaneously. Beginning at the stage shown in FIG. 11A, the outer carriage 38 has been elevated to its uppermost position in order to place the second support surface $s_2$ directly beneath the extended skids 130. The outer arms 58 are pivotally adjusted to their closed positions and the stop members 120 are elevated.

Figure 11A:
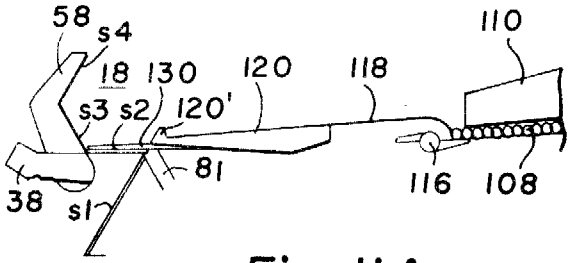
FIGS. 11A-11I are schematic views illustrating the sequence of operation of the apparatus.
Figure 11B:
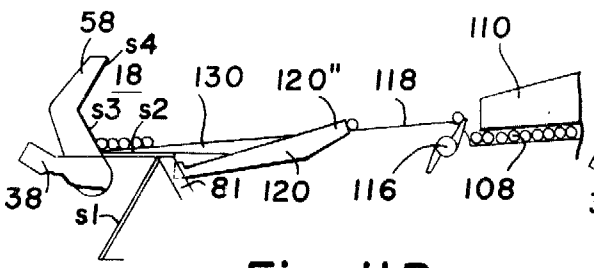

It will be understood that a maximum sized hexagonal bundle is to be produced. Thus, at the operational stage shown in FIG. 11A, the position of the inner carriage 44 relative to the outer carriage is as shown in FIG. 5, with the guide roller 92*b* on control link 94 at the top of slot 96, and with the guide roller 92*d* at the right hand end of slot 100. The inner arm 81 is fully retracted with its cam segments 83 pushed against the cam rollers 92*a*, again as shown in FIG. 5. The picker 116 then operates to transfer individual elements from zone 108 onto the sloping ramp 118. Operation of the picker 116 continues until an appropriate number of elements for the first tier of the hexagonal bundle has been accumulated against the upwardly protruding stops 120'. When a full tier has been accumulated against the stops 120', the stop members 120 are pivotally depressed as shown in FIG. 11B. This allows the accumulated tier of elements to gently roll laterally down along the extended skids 130 until they arrive against the third support surface $s_3$ where they form a neatly packed first tier in the assembly zone 18. While this is occurring, the back ends 120" of the stop members 120 which protrude above the ramp 118 when the stop members are pivotally depressed, prevent elements from continuing down the ramp 118 as the picker 116 continues to operate. As soon as the first element tier has moved past the depressed stops 120', the stop members are again raised to their operative positions, thus permitting a second element tier to begin accumulating at zone 122.

After the first tier has arrived in place on the extended skids 130, the skids are retracted past the upwardly protruding stops 120'. As previously discussed, retraction of the skids is accomplished by rotation of cross shaft 144 in a clockwise direction as viewed in FIG. 5. As the skids 130 are retracted past the stops 120', the element tier is neatly deposited on the underlying second support surface $s_2$ of the outer carriage 38. Since the vertical spacing between the extended skids 130 and the second support surfaces $s_2$ is minimized, the elements are deposited with an absolute minimum of noise.

Figure 11C:
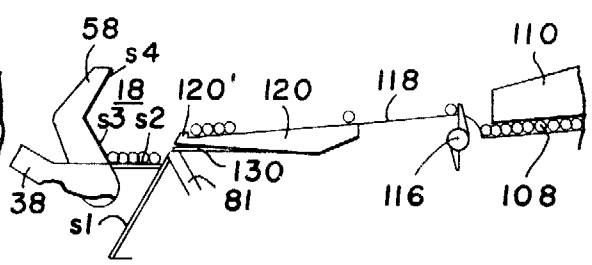

As shown in FIG. 11C, after the first tier is received on support surface $s_2$, the outer carriage 38 is adjusted downwardly by the first operating means 42. This downward adjustment is parallel to the stationary support surface $s_1$ and sufficient to accommodate deposit of the next tier of elements. Referring to FIG. 5, it will be understood that as the outer carriage 38 moves downwardly in a direction parallel to support surface $s_1$, the cam rollers 92*a* move through the same distance along cam segments 83. Since cam segments 83 are parallel to surface $s_1$, the inner arm 81 is held stationary in the retracted position.

Figure 11D:
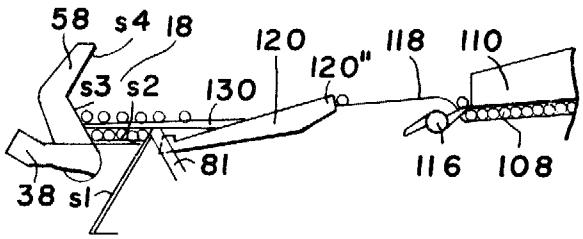

FIG. 11D shows the next tier of elements being deposited on the lowermost tier as the picker 116 continues to shift elements from zone 108 onto the ramp 118.

The operational sequence depicted in FIGS. 11A–11D will continue until the midpoint or "equator" of the hexagonal assemblage of elements is reached. Each time an element tier is deposited on an underlying tier in the assembly zone, the outer carriage 38 will be indexed downwardly. This will cause the cam rollers 92*a* to continue moving downwardly along the cam segments 83, thus continuing to hold the inner arm 81 in its retracted position. The accumulating element tiers in zone 18 will be confined between the first, second and third support surfaces $s_1$, $s_2$ and $s_3$.

Figure 11E:
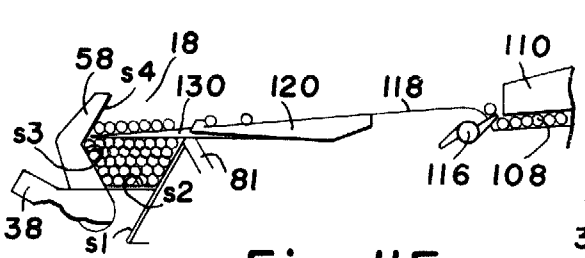
Figure 11F:
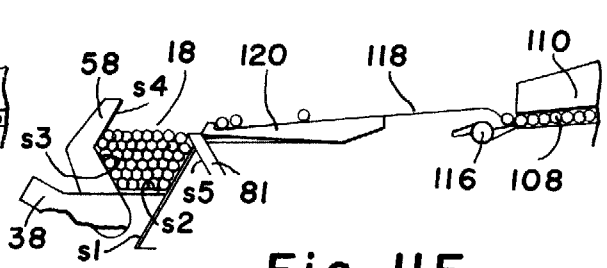

FIG. 11E shows the skids 130 being retracted to deposit a tier of elements above the hexagonal midpoint. After this has been accomplished, and as the outer carriage 38 is again indexed downwardly, the cam rollers 92*a* on control links 94 will roll around the shoulders 85 at the bottom of cam segments 83, and then onto cam segments 84. As soon as this occurs, as shown in FIG. 11E, the inner arm 81 will begin moving past the first support surface $s_1$ into the assembly zone 18. Thus, after the hexagonal mid-point is reached, subsequent element tiers will be confined between the support surfaces $s_4$ and $s_5$.

Figure 11G:
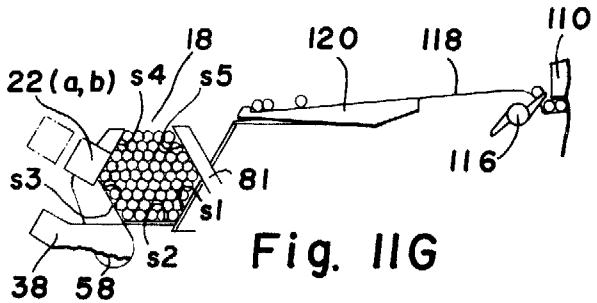

FIG. 11G shows a completed hexagonal assemblage of elongated elements in the assembly zone 18, with the hexagonal cross section being defined by support surfaces $s_1$–$s_5$. At this stage, the strapping machines 22*a*, 22*b*, which may be of any well known conventional design, are employed to apply a plurality of external ties 174 to the assemblage of elements in the assembly zone. The ties 174 are applied with sufficient tension to substantially retain the hexagonal shape defined by the support surfaces $s_1$–$s_5$.

Figure 11H:
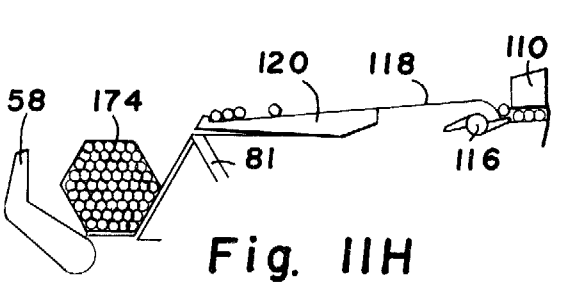
Figure 11I:
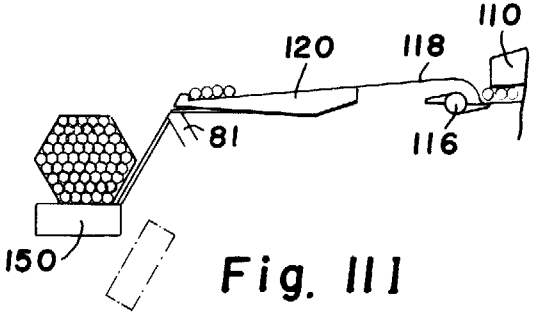

As shown in FIG. 11H, after the elements have been tied into a hexagonal bundle, the arms 58 are pivoted to their open positions. Thereafter, as shown in FIG. 11I, the table rollers 150 are pivoted upwardly to their operative positions, and the outer carriage 38 is dropped slightly to deposit the bundle on the operatively positioned rollers. The motors 156 are then energized to drive the rollers 150, thus propelling the bundle axially in the direction of arrow 26 (see FIG. 1) to the lateral discharge apparatus 28.

Having thus described the invention, the advantages to be derived thereon will now be better appreciated by those skilled in the art. Among these advantages is the ability to gradually accumulate elongated elements in a hexagonal bundle in a carefully controlled manner without haphazardly dropping elements, thus avoiding all of the attendant problems including noise, possible damage to the elements, and danger to operating personnel. Instead, the elements are assembled in an orderly fashion into successive tiers which are gently deposited in an assembly zone defined by a plurality of support surfaces one of which is stationary and the remainder of which are adjusted incrementally to gradually impart a hexagonal cross section to the assemblage of successive tiers. All this is accomplished with an absolute minimum of supervision and attention by operating personnel.

Figure 5A:
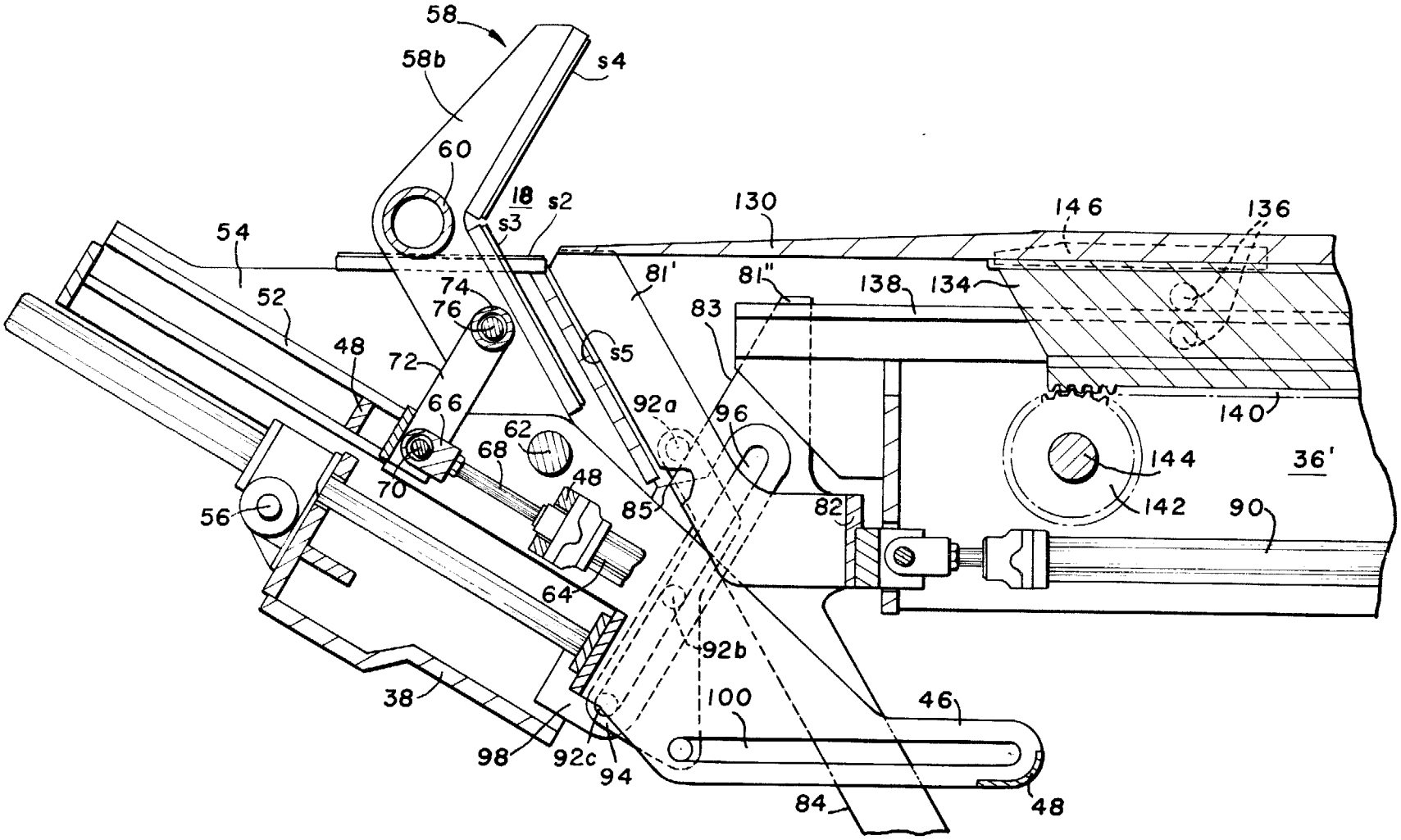

The apparatus is readily adjustable to accommodate a wide range of hexagonal bundle sizes and is thus ideally suited for installations where customer requirements vary considerably. This latter point is illustrated by comparing FIG. 5, which shows the apparatus adjusted for a maximum bundle size, with FIG. 5A, which shows the apparatus adjusted for a minimum bundle size. Adjustment of the apparatus between these two extremes is accomplished by simply shifting the inner housing 44 relative to the outer housing 38, thereby moving the contol link 94 along the length of slot 96.

I claim:

1. An apparatus for forming elongated elements into a hexagonal bundle, comprising: an assembly zone defined by a plurality of support surfaces, one of which is stationary and the remainder of which are movable; delivery means for depositing successive tiers of elongated elements one upon the other in said assembly zone; operating means for adjusting said movable support surfaces in order to gradually impart a hexagonal cross section to the elongated elements accumulating in said assembly zone; and means for tieing a completed assemblage of elongated elements in said assembly zone into a bundle which substantially retains said hexagonal cross section following removal of the bundle from said assembly zone.

2. Apparatus for forming elongated elements into a bundle having a hexagonal cross section comprising: a sloping stationary first support surface defining one side of an upwardly open assembly zone; an outer carriage movable in a direction parallel to said first support surface, said outer carriage having second, third and fourth support surfaces arranged thereon to define three additional sides of said zone, said second support surface being horizontal and adjacent to said first support surface, said third support surface being sloped oppositely to said first support surface and being adjacent to said second support surface, said fourth support surface being parallel to said first support surface and being adjacent to said third support surface; an inner arm movable relative to said first support surface in a direction transverse to the direction of movement of said outer carriage, a fifth support surface on said inner arm arranged to define a fifth side of said zone, said fifth support surface being parallel to said third support surface and being adjacent to said first support surface; delivery means for depositing successive tiers of elongated elements in said zone; first and second operating means for movably adjusting respectively said outer carriage and said inner arm as said element tiers are received in said zone, the said adjustments being coordinated to impart a hexagonal cross section to the accumulating assemblage of elongated elements confined within said zone by said support surfaces; and means for externally tieing a completed assemblage of elongated elements in said zone into a bundle which substantially retains the said hexagonal cross section when the bundle is no longer confined by said support surfaces.

3. The apparatus of claim 2 wherein said third and fourth support surfaces are movably adjustable relative to said second support surface in order to vary the size of the hexagonal cross section being imparted to the assemblage of elongated elements.

4. The apparatus of claim 3 wherein said third and fourth support surfaces are carried on an inner carriage which is mounted on said outer carriage for movement in relation thereto in a direction perpendicular to said first support surface.

5. The apparatus of claims 2, 3 or 4 wherein said third and fourth support surfaces are contiguous and arranged on an outer arm which is pivotally mounted on said inner carriage for adjustment between a closed operative position at which said fourth support surface is parallel to said first support surface, and an open inoperative position permitting removal of said bundle from said assembly zone.

6. The apparatus according to claims 2, 3 or 4 wherein during accumulation of elongated elements in said assembly zone, said second operating means adjusts said inner arm from a retracted position behind said first support surface to an advanced position protruding past said first support surface into said zone.

7. The apparatus according to claim 6 wherein adjustment of said inner arm from said retracted position to said advanced position is controlled by movement of a cam surface on said arm over a cam roller movable with said outer carriage in relation to said first support surface.

8. The apparatus of claim 7 wherein said cam roller is carried on a control link, said control link being mounted on and movable relative to said outer carriage in response to movement of said inner carriage relative to said outer carriage.

9. The apparatus of claim 8 wherein said control link is connected to said inner carriage and is movable relative to said outer carriage in a direction parallel to said first support surface.

10. The apparatus as claimed in claim 2 wherein said delivery means includes a ramp sloping downwardly towards said zone, picker means for laterally shifting elongated elements onto said ramp for subsequent lateral movement thereon towards said zone, stop means adjustable between an inoperative position permitting movement of elongated elements along said ramp to an operative position arresting said movement, the operative positioning of said stop means resulting in an accumulation thereagainst on said ramp of an appropriate number of elongated elements for a given tier, skid means movable from a retracted position behind said stop means to an advanced position therebeyond forming a continuation of said ramp extending across the top of said zone, whereupon retraction of said stop means to said inoperative position permits the elongated elements accumulated thereagainst to continue laterally as a tier along said ramp and said advanced skid means to a position overlying said receiving zone, after which said stop means is returned to its operative position and said skid means is retracted to deposit the tier of the elongated elements into said assembly zone.

* * * * *